US010253532B2

(12) United States Patent
Hansen et al.

(10) Patent No.: US 10,253,532 B2
(45) Date of Patent: Apr. 9, 2019

(54) DOOR HANDLE MOUNTING DEVICE FOR A MOTOR VEHICLE

(71) Applicants: Jeffrey Kenneth Hansen, Pinckney, MI (US); Eugene Kozak, Royal Oak, MI (US); Suat Kaya, Novi, MI (US)

(72) Inventors: Jeffrey Kenneth Hansen, Pinckney, MI (US); Eugene Kozak, Royal Oak, MI (US); Suat Kaya, Novi, MI (US)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 120 days.

(21) Appl. No.: 15/397,279

(22) Filed: Jan. 3, 2017

(65) Prior Publication Data

US 2017/0198505 A1 Jul. 13, 2017

Related U.S. Application Data

(60) Provisional application No. 62/278,129, filed on Jan. 13, 2016.

(51) Int. Cl.
*E05B 85/06* (2014.01)
*E05B 79/06* (2014.01)
(Continued)

(52) U.S. Cl.
CPC ..... *E05B 85/06* (2013.01); *E05B 79/06* (2013.01); *E05B 2009/047* (2013.01); *E05B 2015/041* (2013.01)

(58) Field of Classification Search
CPC .... E05B 85/06; E05B 79/06; E05B 2009/047; E05B 2015/041
(Continued)

(56) References Cited

U.S. PATENT DOCUMENTS 5,285,667 A 2/1994 Fukasawa et al.
6,748,775 B1 * 6/2004 Bucker ..... E05B 79/06 292/DIG. 31
(Continued)

FOREIGN PATENT DOCUMENTS

DE 26 56 011 A1 6/1978
DE 103 22 387 A1 12/2004
(Continued)

OTHER PUBLICATIONS

European Search Report of related EP 16 20 1725 dated May 12, 2023, 8 pages.

*Primary Examiner* — Suzanne L Barrett
(74) *Attorney, Agent, or Firm* — Fay Sharpe LLP

(57) ABSTRACT

A door handle mounting device for a motor vehicle includes a door handle mount with a receiving space and a closing device attached to the door handle mount which is accommodated at least in part in the receiving space. The closing device includes a housing and a cylinder core rotatably supported in the housing and an actuator that is non-rotatably connected to the cylinder core for actuating a lock of the motor vehicle. A return element which exerts a return force on the actuator retains the actuator in its initial position or returns it thereto. The actuator is adapted to be rotated against the return force of the return element from the initial position and to an unlocking position or into a locking position. The return element is disposed lying radially surrounding the cylinder core and outside of the housing.

15 Claims, 5 Drawing Sheets

(51) Int. Cl.
*E05B 15/04* (2006.01)
*E05B 9/04* (2006.01)

(58) Field of Classification Search
USPC ..... 70/210, 237, 370, 371
See application file for complete search history.

(56) References Cited

U.S. PATENT DOCUMENTS

| | | | | |
|---|---|---|---|---|
| 8,474,290 | B2 * | 7/2013 | Terhaar | E05B 17/04 292/21 |
| 9,567,780 | B2 * | 2/2017 | Behnke | E05B 85/06 |
| 9,574,382 | B2 * | 2/2017 | Behnke | E05B 83/42 |
| 9,650,806 | B2 * | 5/2017 | Beck | E05B 3/04 |
| 9,945,155 | B2 * | 4/2018 | Kushida | E05B 27/0007 |
| 2001/0045114 | A1 * | 11/2001 | Sokurenko | E05B 9/08 70/370 |
| 2002/0104343 | A1 * | 8/2002 | Schwab | E05B 17/04 70/237 |
| 2009/0031768 | A1 * | 2/2009 | Yamaguchi | E05B 29/0006 70/357 |
| 2015/0096338 | A1 * | 4/2015 | Behnke | E05B 83/42 70/237 |
| 2015/0096339 | A1 * | 4/2015 | Behnke | E05B 85/06 70/237 |

FOREIGN PATENT DOCUMENTS

| | | | |
|---|---|---|---|
| DE | 10 2012 104889 | A1 | 12/2013 |
| EP | 0 646 688 | A1 | 4/1995 |
| EP | 1 191 170 | A1 | 3/2002 |
| JP | 2009-270347 | A | 11/2009 |

* cited by examiner

DOOR HANDLE MOUNTING DEVICE FOR A MOTOR VEHICLE

This application claims the benefit of U.S. Provisional Application No. 62/278,129, filed Jan. 13, 2016, and is incorporated herein by reference in its entirety.

BACKGROUND

The invention relates to a door handle mounting device for a motor vehicle, having a door handle mount with a receiving space, a locking device that can be attached to the door handle mount, which is accommodated, at least in part, in the receiving space, and which comprises at least a housing, a cylinder core rotatably supported in the housing, and an actuator that is non-rotatably connected to the cylinder core, for actuating a lock of the motor vehicle, and having a return element that exerts a return force on the actuator that retains the actuator in the initial position, or returns it thereto, wherein the actuator can be rotated against the return force of the return element, from the initial position, into an unlocking position or into a locking position.

A door handle mounting device of the type indicated above is known, for example, from DE 10 2012 104 889 A1, which describes a door handle mount having an opening that serves to accommodate a housing of a closing device of the locking cylinder type. A closing device of the type described above is likewise known from the prior art, and is used in combination with a mechanical key for unlocking and locking a lock in a vehicle. With this known closing device, a cylinder core is rotatably supported in the housing, wherein the cylinder core is non-rotatably coupled with an actuator. The actuator can be used to actuate the lock installed in the vehicle, from an initial position into functional positions, which are typically referred to as an unlocking position and a locking position. A return element designed as a type of spring element ensures that the actuator is always returned to the initial position thereby. The spring element is accommodated in the housing of the closing device, and disposed axially in the extension of the cylinder core behind the longitudinal end of the cylinder core and the housing, which requires an enlargement of the installation space for the closing device and thus the door handle mounting device. This is accompanied with the disadvantage that the depth of the door of the motor vehicle must take this installation depth into account. Thus, for the overall depth of the door, i.e. the distance from the exterior surface of the door to the interior surface of the door, in general, the depth required such that the window can be moved past the door handle mounting device when it is lowered must also be taken into account. The depth for lowering the window cannot be reduced, such that the installation depth of the door handle mounting device is decisive in determining the overall depth of the door.

The object of the invention is to develop a door handle mounting device, in a structurally simple manner and economically, having a limited installation depth, and by means of which the overall depth of the door can be reduced.

BRIEF SUMMARY

With a door handle mounting device of the type referred to in the introduction, this object is achieved in accordance with the invention in that the return element radially surrounds the cylinder core, and is disposed outside the housing.

Advantageous and useful designs and developments of the invention can be derived from the dependent claims.

By means of the invention, a door handle mounting device is provided in a structurally simple manner and economically, by means of which the overall depth of the door can be reduced to a minimum. While the return element is disposed inside the housing and axially behind the longitudinal end of the cylinder core in the prior art, this installation depth is reduced by means of the invention, in that the return element is disposed, in particular, radially surrounding the housing, such that no installation space is required in the depth direction, i.e. axially behind the longitudinal end of the cylinder core, but rather, this space is reduced, such that the installation depth of the door handle mounting device, and thus the overall depth of the door can be kept low. This is possible, according to the invention, because the return element is disposed surrounding the outer circumference of the cylinder core.

In the design of the door handle mounting device, the invention provides that a wheel-like or disk-shaped locking element for coupling with the lock of the motor vehicle is rotatably supported on the door handle mount, wherein the actuator is non-rotatably connected to the wheel-like locking element. More precisely stated, the actuator is inserted in a receiving space formed in the middle of the locking element, by means of which the non-rotatable connection is produced. The locking element lies substantially flat inside a receiving space formed in the door handle mount, such that the installation depth of the door handle mounting device is not compromised. Moreover, the return element is attached to the locking element in a retaining manner.

In further designs of the invention, it is structurally particularly useful when the return element is designed as at least one spring element with a first spring leg and a second spring leg, wherein the first spring leg and the second spring leg are spring loaded against one another, and apply the return force that acts on the actuator via the locking element.

In another design, the invention provides that at least one retaining arm is formed on the locking element, by means of which the at least one spring element is retained on the locking element. The spring element, or the return element, respectively, is thus not attached to the cylinder core or the door handle mount, but to the locking element instead, thus simplifying the installation of the door handle mounting device, because the return element can be pre-installed on the locking element, before the locking element itself is rotatably installed on the door handle mount.

In another design, the invention provides that both the first spring leg as well as the second spring leg each bear against a bearing lip. The bearing lip serves as a stationary reference point thereby, having a structurally particularly simple design.

In order that the two spring legs can be spring loaded against one another, and can apply the return force, it is of particular advantage in another design of the invention when both the first spring leg as well as the second spring leg each bear against a movement lip formed on the locking element, such that when the actuator moves from the initial position into the unlocking position or into the locking position, the two spring legs are spring loaded against one another, and apply the return force.

With respect to a simple and economical construction, it is advantageous in the design of the invention when at least one guide arm is formed on the door handle mount, which extends in the longitudinal direction of the housing, and engages behind the peripheral edge of the wheel-like locking element, at least in the initial position, and at least during a movement from the initial position into the unlocking position or into the locking position.

In order to increase the installation simplicity, in another design the invention provides that the peripheral edge of the wheel-like locking element has at least one installation recess, wherein the locking element can be rotated into an installation position in order to be installed on the door handle mount, in which position the at least one guide arm is disposed such that it is flush with the at least one installation recess, and does not engage behind the peripheral edge of the wheel-like or disk-shaped locking element.

Lastly, in another design, the invention provides that a lever arm is formed on the wheel-like locking element, which extends beyond the peripheral edge of the locking element, and can be coupled to the lock of the motor vehicle. The entire structural unit, comprising the locking device, the locking element, which is placed on the actuator for the locking device, and the return element, which is non-rotatably attached to the locking element, and bears against the door handle mount, can be designed with a reduced installation depth, which is further supported by the lever arm, which extends radially over the peripheral edge of the locking element.

It is to be understood that the features specified above and still to be explained below may be implemented, not only in the respective given combination, but also in other combinations or in and of themselves, without abandoning the scope of the present invention. The scope of the invention is only defined by the Claims.

BRIEF DESCRIPTION OF THE DRAWINGS

Further details, features and advantages of the subject matter of the invention can be derived from the following description in combination with the drawings, in which an exemplary, preferred embodiment example of the invention is depicted. Therein.

DETAILED DESCRIPTION

Figure 1:
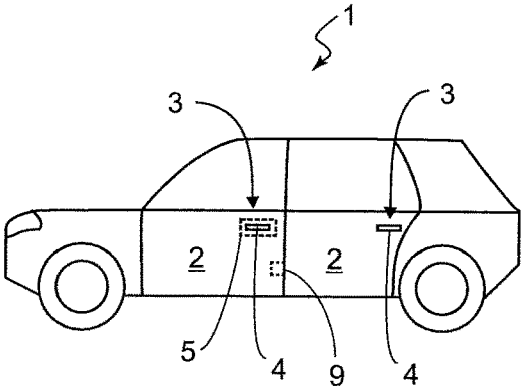
FIG. 1 shows a side view of a motor vehicle having a door handle mounting device according to the invention.
Figure 2:
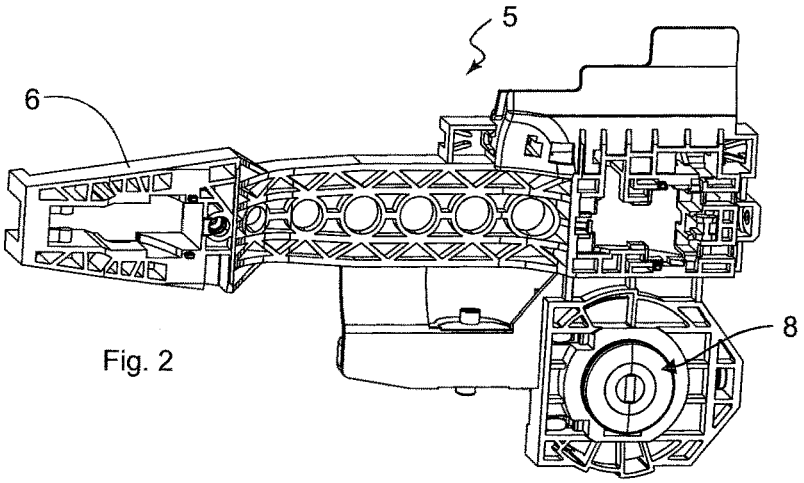
FIG. 2 shows a perspective front view of the door handle mounting device according to the invention.
Figure 3:
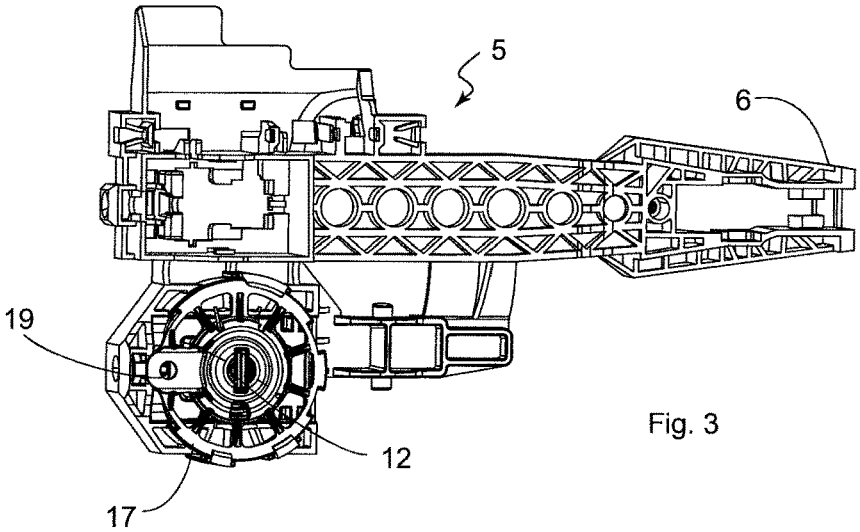
FIG. 3 shows a perspective rear view of the door handle mounting device according to the invention.
Figure 4:
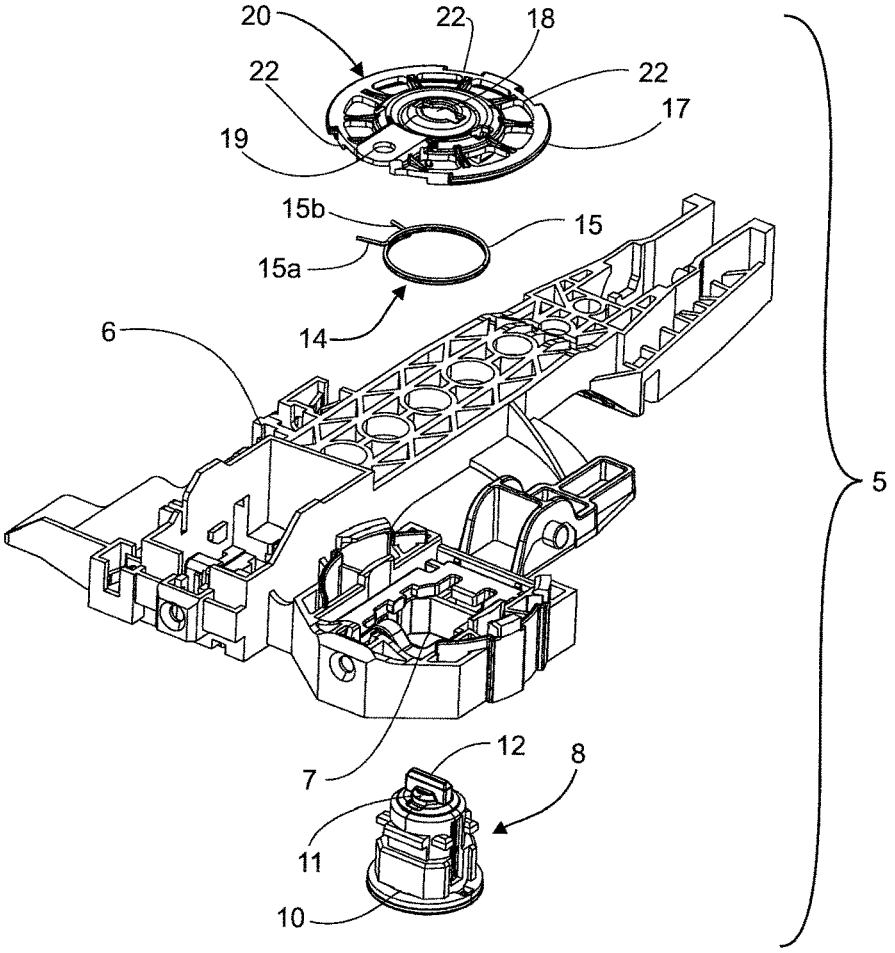
FIG. 4 shows a perspective exploded view of the door handle mounting device according to the invention.
Figure 11:
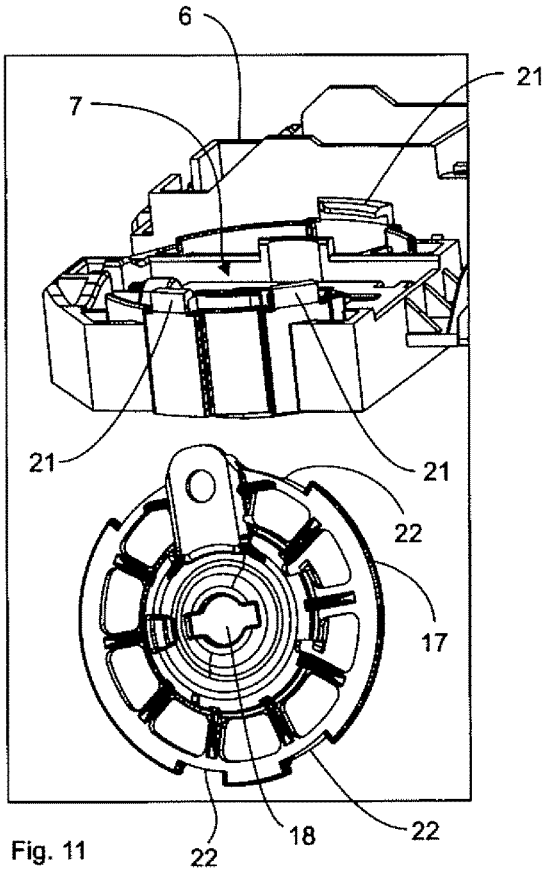
FIG. 11 shows a perspective exploded view of the door handle mount and the locking element.

In FIG. 1 a vehicle, or motor vehicle 1, respectively, is depicted by way of example in the form of a passenger car, having four doors 2 (two of which are visible in FIG. 1), which can be opened via a door handle assembly 3 and in particular using a door handle, or a handle 4, respectively. The handle 4 is moveably supported on a door handle mounting device 5 that is only schematically indicated for the driver door 2. The door handle mounting device 5 is shown in FIG. 2 in a front view, whereas a rear view of the door handle mounting device 5 is depicted in FIG. 3. The door handle mounting device 5 has a frame-like door handle mount 6, which is designed in the known manner for the attachment of the handle 4, and is attached to the inside of the door 2 by means of screw connections, not shown in detail, wherein the handle 4 is disposed on the outside of the door 2. The door handle mount 6 is substantially formed by a frame structure for the purpose of material reduction, having various receiving and supporting spaces, in order to be able to accommodate the handle 4 among other things, which is moveably and/or pivotally supported on the door handle mount 6 in order for a user to open a corresponding door 2 of the motor vehicle 1. FIG. 4 shows a perspective exploded view of the door handle mounting device 5 according to the invention. This comprises, in addition to the frame-like door handle mount 6, a receiving frame 7 (see FIGS. 4 and 11, by way of example), formed on the door handle mount 6, into which a closing device 8 of the door handle mounting device 5 extends at least partially, and is accommodated therein. The closing device 8 can be used to unlock or lock a vehicle-side closing system 9 (such as a lock or a central locking system schematically indicated in FIG. 1) through the use of a mechanical key, in order to be able to unlock or lock the doors 2. The closing device 8 itself has a housing 10, and cylinder core 11 that is rotatably supported in the housing 10 (see FIG. 4 for example), comprising, in the known manner, a keyhole for receiving a key, not shown in detail, and spring loaded tumblers. An actuator 12, non-rotatably connected to the cylinder core, is disposed on the longitudinal side of the cylinder core 11 facing away from the opening of the keyhole, which is designed in the present exemplary embodiment as an integral part of the cylinder core 11 and has a paddle shape. The actuator 12 is designed for actuating the vehicle-side closing system 9, and is coupled thereto. The cylinder core 11 can be rotated by a mechanical key, such that when the cylinder core 11 is rotated, the actuator 12 coupled to the closing system 9 is rotated, wherein the rotation for unlocking or locking the door 2 is transferred to the motor vehicle-side closing system 9. The further construction of the closing device 8 is known from the prior art, such that a detailed description of the individual components of the closing device 8 and their interactions shall not be included here.

Figure 5:
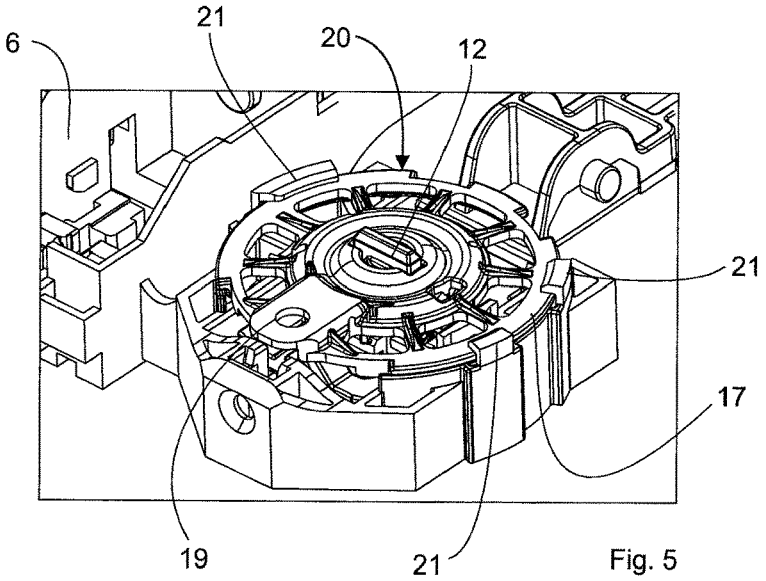
FIG. 5 shows an enlarged perspective view of a locking element and an actuator of the door handle mounting device disposed in the initial position
Figure 6:
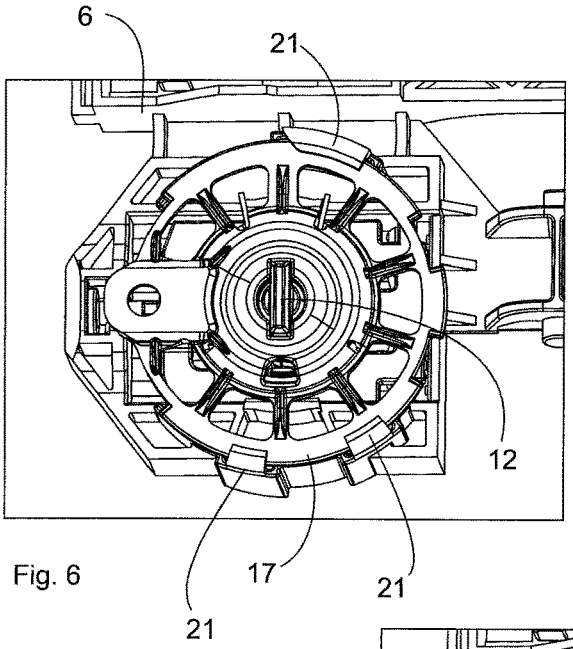
FIG. 6 shows a perspective top view of the locking element and the actuator in the initial position.
Figure 7:
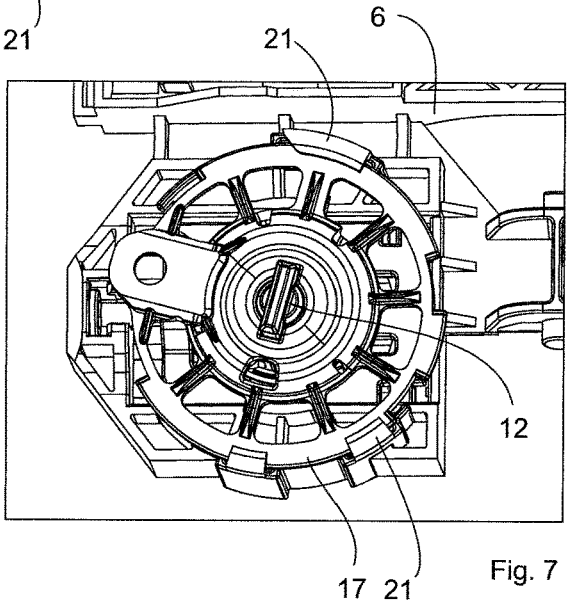
FIG. 7 shows another perspective top view of the locking element and the actuator in the unlocking position.
Figure 8:
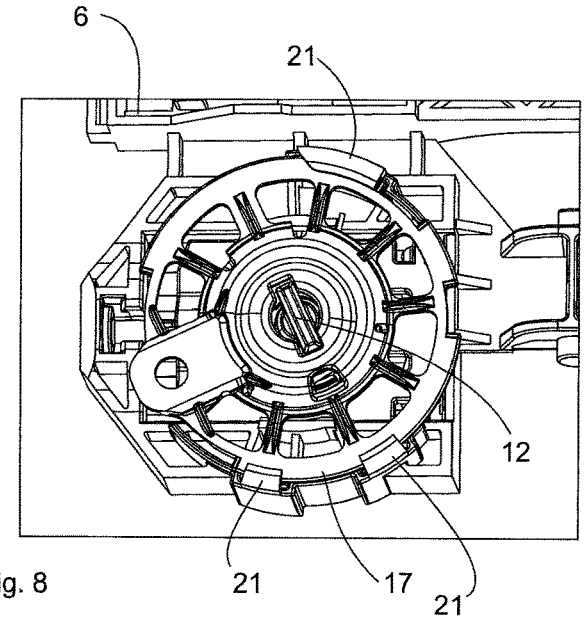
FIG. 8 shows another perspective top view of the locking element and the actuator in the locking position.
Figure 12:
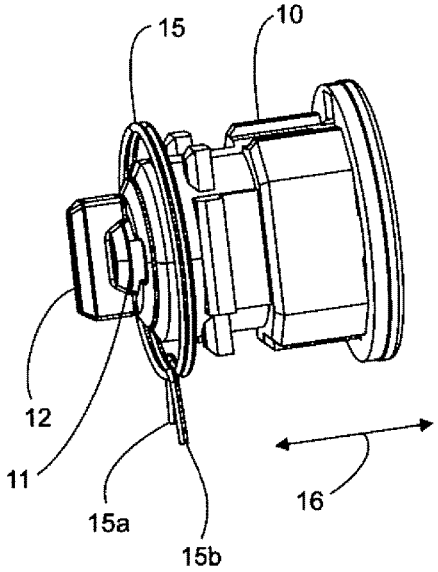
FIG. 12 shows a side, perspective view of a closing device and a return element of the door handle mounting device.

For the locking or unlocking, the cylinder core 11, and thus the paddle-shaped actuator 12 are therefore rotated from an initial position, shown in FIGS. 5 and 6, in different directions, in order to end up in an unlocking position (see FIG. 7, for example) or a locking position (see FIG. 8, for example). The initial position is determined by a return element 14 thereby. The return element 14 is designed as an annular spring element 15 having a first spring leg 15*a* and a second spring leg 15*b* in the exemplary embodiment depicted in the Figures, wherein the first spring leg 15*a* and the second spring leg 15*b* are spring loaded against one another, and apply the return force that acts indirectly on the actuator 12. The spring element 15 has an annular design with numerous windings thereby. The two legs 15*a* and 15*b* extend radially outward at different peripheral positions of the spring element 15. In differing from the prior art, the return element 14, or the annular spring element 15 is not disposed, in accordance with the present invention, inside the housing 10 of the closing device 8, and is also not disposed axially behind the cylinder core 11, or behind the cylinder core seen from the longitudinal direction 16 (see FIG. 12, for example) of the housing 10, respectively. Instead, the return element 14, or the spring element 15, respectively, is disposed outside the housing 10, and radially encompassing the cylinder core 11, by means of which the installation depth can be reduced in comparison to devices known from the prior art. More precisely, the annular spring element 15 is disposed surrounding the outer periphery of the cylinder core 11, wherein the spring element 15 is also disposed surrounding the outer periphery of the housing 10 in the exemplary embodiment. In order to further reduce the installation depth, the actuator 12 is not coupled to a protruding locking pin, as in the prior art, but rather, it is coupled with a wheel-like locking element 17. Alternatively, the locking element 17 may also be designed as a solid disk, wherein cutouts are provided in the present exemplary embodiment, in order to reduce material and weight, by means of which the wheel-like design of the locking element 17 is obtained. The wheel-like locking element 17 has a central receiving hole 18, which is adapted to the contour of the paddle-shaped actuator 12. The locking element 17 is attached to the actuator 12, such that the actuator 12 is non-rotatably connected to the locking element 17, as can be seen, by way of example, in FIG. 5. A lever arm is formed on the wheel-like locking element 17, which extends radially beyond the circumferential edge 20 of the locking element 18, and can be coupled to the lock 9 of the motor vehicle 1 (see FIG. 4, for example).

Regarding the fundamental functioning of the closing device 8, the following should be noted: The cylinder core 11 is prevented from rotating by the tumblers, not shown in detail in the Figures, when the actuator 12 is in the initial position. When an appropriate key is inserted, the cylinder core 11 is released, and can be selectively rotated in one or the other direction for unlocking or locking, wherein the actuator 12 is rotated to an unlocking position or a locking position. If the key is released after the rotation, the actuator 12, and thus the cylinder core 11 as well, is returned to the lockable initial position illustrated in FIGS. 5 and 6, by means of the return element 14, or the spring element 15, respectively. The return rotation occurs automatically by means of the return element 14, or the spring element 15, respectively, as shall be described below.

Figure 9:
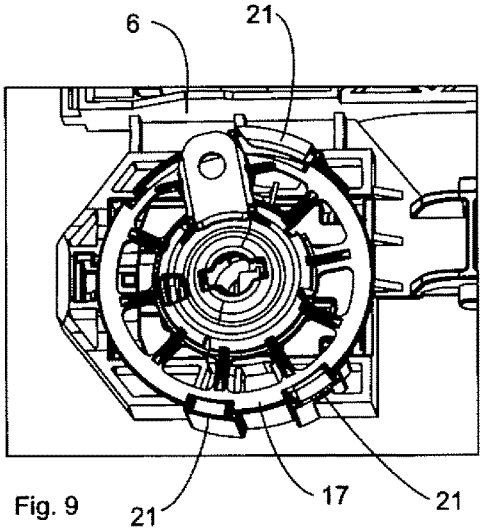
FIG. 9 shows another perspective top view of the locking element in the installation position.

As explained above, the locking element 17 is attached to the actuator 12. Moreover, the locking element 17 is rotatably supported via the actuator 12 on the door handle mount 6. In order to ensure that the locking element 12 cannot be released from the non-rotatable attachment to the actuator 12, guide arms 21 are formed on the door handle mount 6, which extend in the longitudinal direction 16 of the housing 10. The guide arms 21 are disposed on the circumferential edge 20 of the wheel-like locking element 17, and engage behind the circumferential edge 20 of the locking element 17, at least in the initial position, and at least in the case of a movement from the initial position into the unlocking position or from the initial position into the locking position. This is because the wheel-like locking element 17 is coupled to the door handle mount 6 in the manner of a bayonet joint. For this purpose, the circumferential edge 20 of the wheel-like locking element 17 has installation recesses 22 (see FIGS. 4 and 11, for example), the number of which corresponds to the number of guide arms 21. The interaction of the installation recesses 22 and the guide arms 21 is illustrated in FIG. 9, in which the locking element 17 is disposed in an installation position. In the installation position, the guide arms 21 are disposed flush with the installation recesses 22, such that when the locking element is installed on the door handle mount 6, the guide arms 21 end up behind the circumferential edge 20 of the locking element 17, and can engage behind it. When the locking element 17 is in the installed position, the guide arms 21 do not engage behind the circumferential edge 20 of the wheel-like locking element 17, such that the locking element 17 can move in the longitudinal direction 16 of the housing 10. When the guide arms 21 engage behind the circumferential edge 20 of the locking element 17, the locking element 17 is then immobile in the longitudinal direction, but is rotatably retained on the door handle mount 6, and can be rotated into this position, in which the actuator 12 can be inserted into the receiving hole 18 of the locking element 17, when the closing device 8 is mounted on the door handle mount 6.

Figure 10:
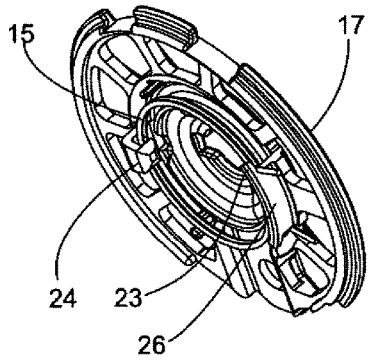
FIG. 10 shows a perspective view of the locking element.
Figure 14:
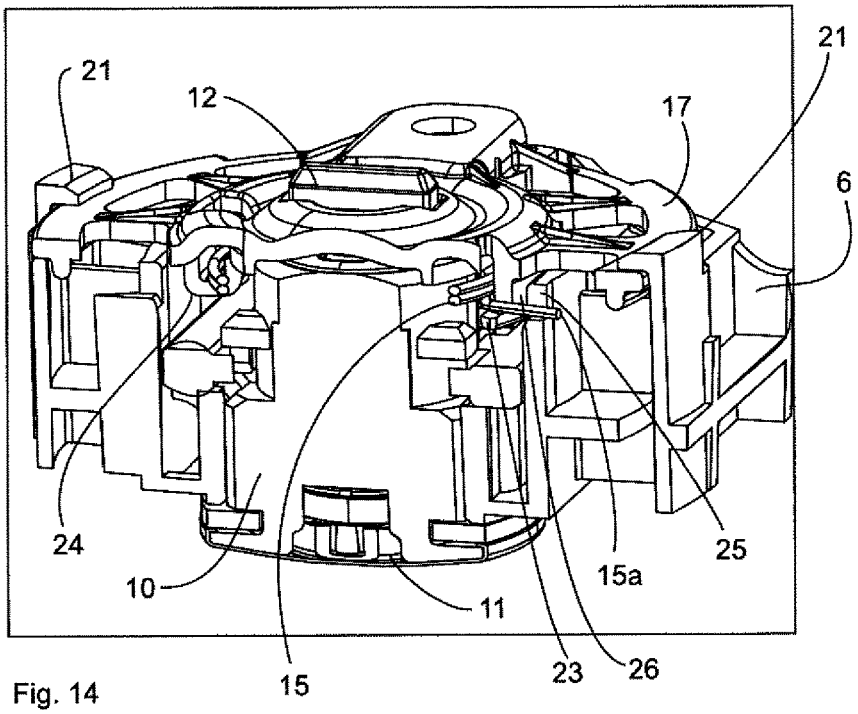
FIG. 14 shows a side sectional view of the door handle mounting device.

The return element 14, designed as an annular spring element 15 is attached to a lateral surface of the locking element 17. More precisely, the spring element 15 is attached to the lateral surface of the locking element 17 facing toward the closing device 8. The outer circumference of the locking element 17 is greater than the outer circumference of the return element 14, or the spring element 15, thereby, such that the spring element 15 is disposed inside the locking element 17 when regarded radially or from the circumference. The return element 15 is disposed between the locking element 17 and the door handle mount 6. In order to attach the spring element 15 to the locking element 17 the locking element 17 has a first retaining arm 23 and a second retaining arm 24, which extend in the longitudinal direction 16 of the housing 10, and are disposed diametrically to one another, as can be seen, for example, in FIGS. 10 and 14. The windings of the spring element 15 are clipped into the L-shaped retaining arms 23 and 24, and it is retained in this manner on the locking element 17, wherein alternative retaining possibilities may also be considered.

Figure 13:
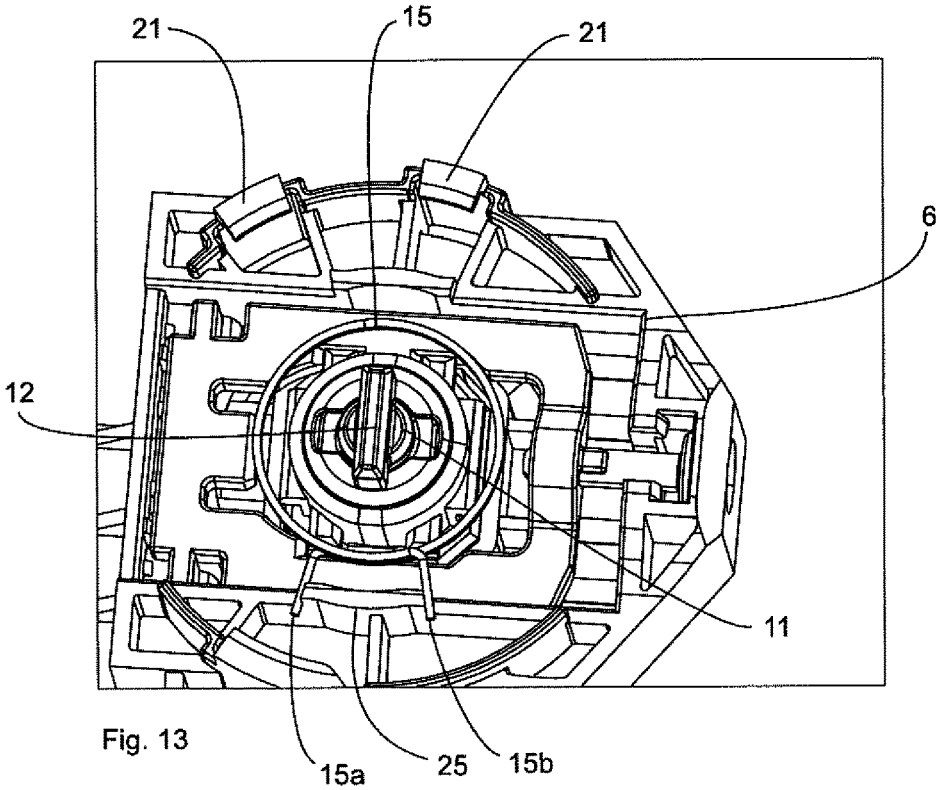
FIG. 13 shows a perspective top view of the door handle mount and the closing device attached thereto, and the arrangement of the return element after installation, while omitting the locking element in this illustration.

In order for the spring element 15 to be able to apply a return force when the locking element 17 is rotated by rotating the cylinder core 11 via the actuator 12 that has been moved into either the locking position (see FIG. 8, for example) or into the unlocking position (see FIG. 7, for example), the spring legs 15*a* and 15*b* must be able to bear against a stationary point as well as against a point that is moved along with the cylinder core 11. In the initial position, both spring legs 15*a* and 15*b* bear against a stationary bearing lip 25 (see FIGS. 13 and 14, for example), formed on the door handle mount 6, wherein only the first spring leg 15*a* is visible in the sectional view of FIG. 14, in terms of how it bears against the bearing lip 25. The second spring leg 15*b* bears against the other side of the bearing lip 25. Thus, the spring legs 15*a* and 15*b* bear on opposite sides of the stationary bearing lip 25, as can be seen in particular in FIG. 13. It can be readily seen in FIG. 13, due to the omission of the locking element 17 (the spring element 15 is disposed, however, in its position in FIG. 13, in which it is attached to the locking element 17), such that the return element 14, designed as the spring element 15, is disposed outside the housing 10, and lies radially surrounding the housing 10 and the cylinder core 11. In particular, the spring element 15 is placed over the housing 10 and the cylinder core 11, and as a result, does not occupy any structural space behind the longitudinal ends of the closing device 8. Furthermore, when the actuator 12 is in the initial position, the first spring leg 15*a* as well as the second spring leg 15*b* each bear against opposite sides of a movement lip 26 formed on the locking element 18. The movement lip 26 thus forms the point that is moved when the cylinder core 11 is rotated, by means of which the spring legs 15*a* and 15*b* are spread apart from one another, by means of which the return force is applied, which forces the cylinder core 11, the actuator 12, and the locking element 17, which are non-rotatably connected to one another, into the initial position of the actuator 12, when the key inserted in the cylinder core 11 is released after being turned. As a result, when the actuator 12 is moved out of the initial position into the unlocking position or into the locking position, the two spring legs 15*a*, 15*b* become spring loaded against one another, and as a result, apply the desired return force, in order to move the actuator 12, and thus the cylinder core 11, back into the initial position.

In summary, a door handle mounting device 5 is created by means of the present invention, which is distinguished by a reduced installation depth in comparison with the devices known from the prior art. The door handle mounting device 5 described above has a return element 14 for this purpose, which is disposed outside the housing 10, and radially surrounds the cylinder core 11. In particular, the annular return element 14 is disposed radially surrounding the cylinder core 11. The reduced installation depth further benefits from the wheel-like locking element 17, which is coupled to the closing device 8 of the vehicle instead of the actuator 12.

The invention described above is not limited to the described and depicted embodiment, as a matter of course. It is clear that numerous modifications could be made to the embodiment depicted in the drawings by a person skilled in the art, corresponding to the intended use, without abandoning the field of the invention thereby. As such, a different number of spring elements, movement lips, guide arms and retaining arms than those in the embodiment may be provided in alternative versions of the exemplary embodiment described herein. Everything contained in the description and/or depicted in the drawings, including that which, deviating from the concrete exemplary embodiment, is obvious to the person skilled in the art, belongs to the invention.

The invention claimed is:

1. A door handle mounting device of a motor vehicle comprising:

a door handle mount with a receiving space, a closing device attached to the door handle mount which is accommodated at least in part in the receiving space and which comprises at least a housing, a cylinder core rotatably supported in the housing, and an actuator that is non-rotatably connected to the cylinder core for actuating a lock of the motor vehicle, a return element which exerts a return force on the actuator that retains the actuator in an initial position or returns it thereto, wherein the actuator is adapted to be rotated against the return force of the return element from the initial position into an unlocking position or into a locking position, wherein the return element is disposed lying radially surrounding the cylinder core and is located outside the housing, wherein the door handle mounting comprises a wheel-like locking element for coupling to the lock of the motor vehicle, wherein the wheel-like locking element is rotatably supported on the door handle mount and the actuator is non-rotatably connected to the wheel-like locking element, and wherein the return element is designed as at least one spring element including a first spring leg and a second spring leg, wherein the first spring leg and the second spring leg are spring loaded against one another, and apply the return force, which acts on the actuator via the wheel-like locking element.

2. The door handle mounting device according to claim 1, wherein at least one retaining arm is formed on the wheel-like locking element such that the at least one spring element is retained on the wheel-like locking element.

3. The door handle mounting device according to claim 1, wherein both the first spring leg and the second spring leg bear against a bearing lip formed on the door handle mount.

4. The door handle mounting device according to claim 1, wherein both the first spring leg and the second spring leg bear against a movement lip formed on the wheel-like locking element such that when the actuator is moved from the initial position into the unlocking position or into the locking position, the two spring legs are spring loaded against one another, and apply the return force.

5. The door handle mounting device according to claim 1, wherein at least one guide arm is formed on the door handle mount, the guide arm extending in a longitudinal direction of the housing and engaging behind a peripheral edge of the wheel-like locking element at least in the initial position and at least when moved from the initial position into the unlocking position or into the locking position.

6. The door handle mounting device according to claim 5, wherein the peripheral edge of the wheel-like locking element has at least one installation recess wherein the wheel-like locking element can be rotated into an installation position in order to install it on the door handle mount, in which position the at least one guide arm is disposed flush with the at least one installation recess and does not engage behind the peripheral edge of the wheel-like locking element.

7. The door handle mounting device according to claim 1, wherein a lever arm is formed on the wheel-like locking element which extends radially beyond a peripheral edge of the wheel-like locking element and can be coupled to the lock of the motor vehicle.

8. The door handle mounting device according to claim 2, wherein both the first spring leg and the second spring leg bear against a bearing lip formed on the door handle mount.

9. The door handle mounting device according to claim 2, wherein both the first spring leg and the second spring leg bear against a movement lip formed on the wheel-like locking element such that when the actuator is moved from the initial position into the unlocking position or into the locking position, the two spring legs are spring loaded against one another, and apply the return force.

10. The door handle mounting device according to claim 3, wherein both the first spring leg and the second spring leg bear against a movement lip formed on the wheel-like locking element such that when the actuator is moved from the initial position into the unlocking position or into the locking position, the two spring legs are spring loaded against one another, and apply the return force.

11. The door handle mounting device according to claim 1, wherein at least one guide arm is formed on the door handle mount, the guide arm extending in a longitudinal direction of the housing and engaging behind a peripheral edge of the wheel-like locking element at least in the initial position and at least when moved from the initial position into the unlocking position or into the locking position.

12. The door handle mounting device according to claim 2, wherein at least one guide arm is formed on the door handle mount, the guide arm extending in a longitudinal direction of the housing and engaging behind a peripheral edge of the wheel-like locking element at least in the initial position and at least when moved from the initial position into the unlocking position or into the locking position.

13. The door handle mounting device according to claim 3, wherein at least one guide arm is formed on the door handle mount, the guide arm extending in a longitudinal direction of the housing and engaging behind a peripheral edge of the wheel-like locking element at least in the initial position and at least when moved from the initial position into the unlocking position or into the locking position.

14. The door handle mounting device according to claim 4, wherein at least one guide arm is formed on the door handle mount, the guide arm extending in a longitudinal direction of the housing and engaging behind a peripheral edge of the wheel-like locking element at least in the initial position and at least when moved from the initial position into the unlocking position or into the locking position.

15. The door handle mounting device according to claim 14, wherein the peripheral edge of the wheel-like locking element has at least one installation recess wherein the wheel-like locking element can be rotated into an installation position in order to install it on the door handle mount in which position the at least one guide arm is disposed flush with the at least one installation recess and does not engage behind the peripheral edge of the wheel-like locking element.

* * * * *